US005396211A

United States Patent [19]

Noguchi et al.

[11] Patent Number: 5,396,211

[45] Date of Patent: Mar. 7, 1995

[54] MINIATURE TRANSFORMER HAVING COMPRESSED LAMINATIONS

[75] Inventors: Minoru Noguchi; Hiroshi Noda; Tetsuro Ishikawa, all of Sakado, Japan

[73] Assignee: Tamura Corporation, Tokyo, Japan

[21] Appl. No.: 189,339

[22] Filed: Jan. 27, 1994

[30] Foreign Application Priority Data

Feb. 3, 1993 [JP] Japan ..... 5-039322

[51] Int. Cl.[6] ..... H01F 27/02; H01F 27/26

[52] U.S. Cl. ..... 336/92; 336/198; 336/210

[58] Field of Search ..... 336/210, 198, 208, 90, 336/92, 65, 192

[56] References Cited

U.S. PATENT DOCUMENTS 3,243,746 3/1966 Doggart et al. ..... 336/198

5,157,368 10/1992 Okano et al. ..... 336/198

*Primary Examiner*—Thomas J. Kozma

*Attorney, Agent, or Firm*—Joseph C. Mason; Ronald E. Smith

[57] ABSTRACT

A very small and thin transformer to be used as incorporated in an electronic device for the civil life. In this transformer, a coil is wound on a coil bobbin in which core sheets are incorporated as laminated. This laminated core is provided with an insulating cover for insulation. However, when a gap is produced between the core sheets, an adverse influence will be produced on the electric characteristics of the transformer. Therefore, in case the insulating cover is applied to cover the laminated core, the insulating cover having a resiliency will press the core sheets in the laminating direction to prevent a gap from being produced between the core laminations.

4 Claims, 2 Drawing Sheets

MINIATURE TRANSFORMER HAVING COMPRESSED LAMINATIONS

BACKGROUND OF THE INVENTION (1) Field of the Invention

This invention relates to very small and thin transformers for communication to be used as incorporated in such electronic devices as,for example, miniature facsimiles, modems and miniature terminal devices having modem functions and more particularly to a miniature transformer provided with an insulating cover having a function of pressing in the laminating direction a core incorporated as laminated in a coil bobbin.

(2) Description of the Prior Art

In a transformer in the prior art, a laminated core is incorporated and is provided with an insulating cover which has been used in order to secure a surface and spatial distance solely among a primary coil, secondary coil and core.

This thin transformer is so small as to be, for example, 13 cm long vertically, 16 cm long horizontally and 3 cm thick and the number of laminations to be incorporated into the core is so few as to be about 4 to 14 sheets in case the core sheet is 0.15 mm thick and to be about 3 to 8 sheets in case it is 0.20 mm thick. When a gap is produced between the laminations incorporated in the core, such transmission characteristics as impedance characteristics and frequency characteristics in the case of a transmission transformer will be deteriorated, the transmission waveform will be deteriorated and such adverse influences will be produced on the electric characteristics of the transformer. Therefore, it is necessary to intimately bond the core laminations without a gap between them.

SUMMARY OF THE INVENTION

This invention is suggested in view of the above mentioned fact and has it as an object to provide a miniature transformer provided with an insulating cover having a function of pressing laminated cores in the laminating direction to laminate the respective core sheets as intimately bonded.

In this invention, core sheets laminated and incorporated from the front and rear in the axial direction into a coil bobbin 1 in which a coil 5 is wound on a barrel part 2, then first and second insulating cover halves 9,9 are opposed to the respective laminated cores 8 and are connected in the tip portions to apply an insulating cover 9 around the cores 8, these respective first and second insulating cover halves 9,9 are respectively substantially U-shaped as a whole and have on the insides groove-like core containing parts 10 for containing leg parts **8*b* and their connecting parts 8*c* on both sides of the cores 8 and the lower part of the tip portion of at least either one arm part 9A of each of the first and second insulating cover halves 9,9 is shaped as inclined with a slope made in advance so that the cores 8 may be pressed upward in case the tip portions are incorporated into the coil bobbin 1** to attain the above mentioned object.

That is to say, the exposed portions except central legs **8*a* of the laminated cores 8 incorporated in the coil bobbin 1 are covered with an insulating cover 90 made by connecting the first and second insulating cover halves 9,9 having the core containing parts for containing those portions. In this case, connecting parts 13B having a resiliency to lift upward the lower parts of the cores 8 will be formed in the tip parts of the respective cover halves to thereby press upward the lower sides of the laminated cores 8 and prevent a gap from being produced between the laminations of the cores 8**.

DESCRIPTION OF THE PREFERRED EMBODIMENT

Figure 1:
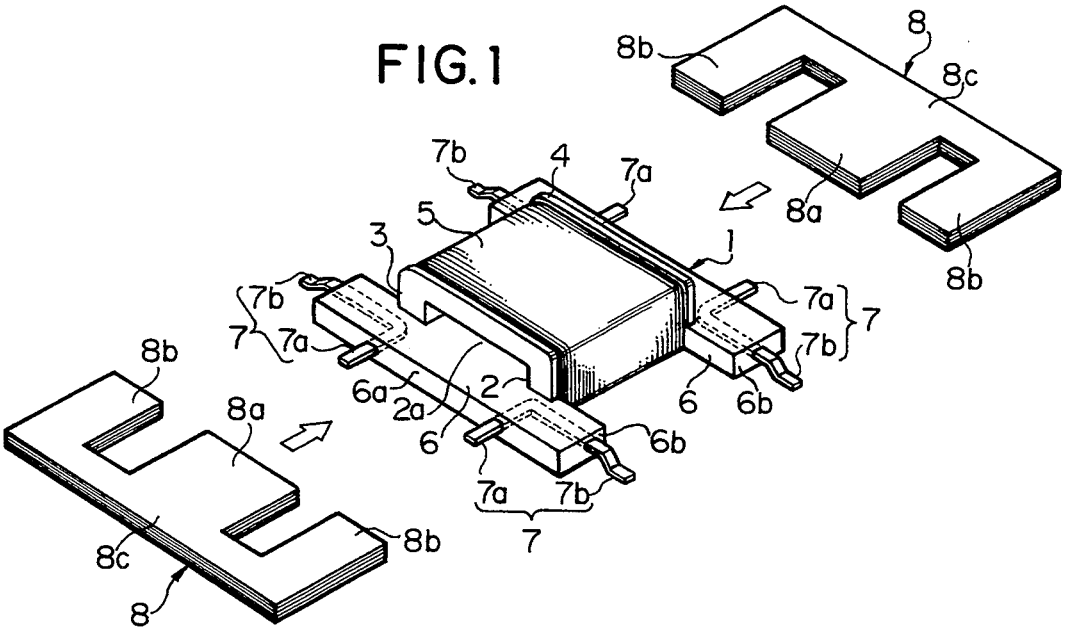
FIG. 1 is a perspective view showing a coil bobbin used in an embodiment of the present invention and E-shaped cores to be incorporated in this coil bobbin.

FIG. 1 shows a coil bobbin 1 used in an embodiment of the present invention and laminated cores 8 shaped, for example, as E to be incorporated in this bobbin. The coil bobbin 1 is made of a molding of an insulative synthetic resin. The coil bobbin 1 has a hollow barrel part 2, respective flanges 3 and 4 are formed at both ends of the barrel part 2 and a coil 5 is wound around the outer periphery of the barrel part 2.

Also, a substantially rectangular thick plate-like part 6 projecting outward is formed below the flanges 3 and 4 of the coil bobbin 1. L-shaped terminals 7 are embedded in the angle parts in the corners of this plate-like part 6. The embedded portions are shown by broken lines. One end part **7*a* of the terminal 7 projects straight out of the end surface 6*a* of the plate-like part 6 and a winding beginning and ending pulled-out wire of the coil 5 not particularly illustrated is connected to this projecting part. The other end part 7*b* of the terminal 7 is projected out of the side part 6*b* of the plate-like part 6. This end part 7*b* is bent downward so that the coil bobbin 1** may be fitted as mounted on a printed substrate. Such fitting is called a surface fitting.

The core 8 is made of nickel or permalloy. A plurality of thin core laminations are incorporated into the coil bobbin 1 from the right and left sides of the coil bobbin 1. In the illustrated embodiment, the core 8 is E-shaped and consists of a central leg **8*a* positioned in the center, both leg parts 8*b* positioned on both sides of it and a connecting part 8*c* connecting them. The central leg 8*a* is inserted into the hollow part 2*a* of the barrel part 2 and the leg parts 8*b* located on both sides of the central leg 8*a* are positioned on the upper surface of the plate-like part 6**.

Figure 2:
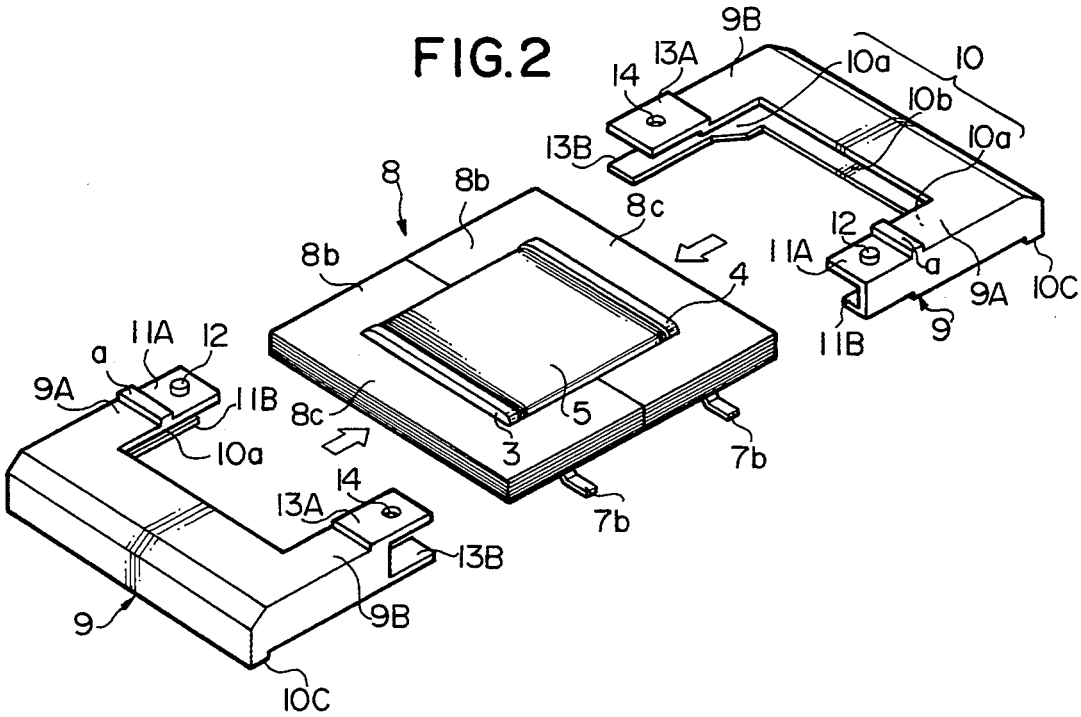
FIG. 2 shows the cores incorporated in the coil bobbin as being fitted with an insulating cover.

FIG. 2 shows cores 8 of a plurality of core laminations incorporated in the coil bobbin 1 as being fitted with two first and second insulating cover halves 9,9 made of such resin moldings as of an epoxy resin.

The insulating cover made of the resin in this embodiment consists of the first insulating cover half 9 substantially U-shaped in the entire shape and shown on the right side shape and the second insulating cover half 9 of the same shape as of the first insulating cover half 9, arranged on the opposite side as opposed to the first half 9 and connectable with the first half 9 through the respective tip parts. Respective groove-like core containing parts 10 are formed on the insides of these two first and second insulating cover halves 9,9.

The core containing part 10 is provided with a pair of core containing parts **10*a*** for containing both leg parts 8*b* of the core 8 and a core containing part 10*b* also of a U-shaped cross-section connecting arm-like core containing parts extending in parallel with each other and containing the connecting part 8*c* of the core 8. A short columnar engaging projection 12 is formed in a substantially central part on the upper surface of one tip part 11A of the core containing part 10*a* of the first insulating cover half 9 shown on the right side in the drawing.

The tip part of the other core containing part 10*a* of the first insulating cover half 9 consists of connecting pieces 13A and 13B provided as opposed above and below and an engaging hole 14 is formed substantially in the upper center of the upper connecting piece 13A.

Figure 3:
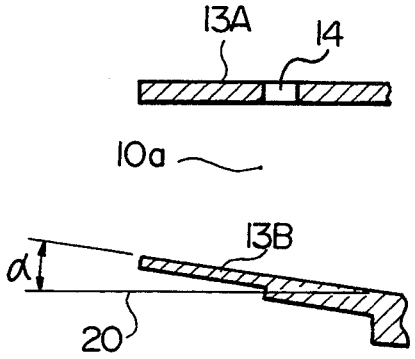
FIG. 3 is an explanatory view of the tip part having a resiliency of an insulating cover half.

The lower side connecting piece 13B opposed to it is shaped as sloped diagonally upward with an angle $\alpha$ with a horizontal line 20 in advance in shaping as shown more particularly in FIG. 3, is made thin, has a resiliency caused by the material of the resin and is given a spring action.

On the other hand, the other second insulating cover half 9 arranged as opposed in a position on the opposite side is also formed the same. As they are opposed to each other, the respective engaging projection 12 and engaging hole 14 will be opposed to each other so that the engaging projection 12 may enter and engage the engaging hole 14.

That is to say, the first insulating cover half 9 has two arm parts 9A and 9B extending in parallel with each other, the engaging projection 12 is formed above the connecting part of the tip of one arm part 9A and the engaging hole 14 is formed above the connecting piece 13A at the tip of the other arm part 9B.

The second insulating cover half 9 is formed also to be of the same shape as of the first insulating cover half 9, they are opposed to each other and the respective engaging projections 12 are engaged with the corresponding engaging holes 14 to integrate both insulating cover halves 9,9.

By the way, downward projections 10*c* are formed in the lower parts of the outside walls of the connecting parts 10*b* of the core containing parts 10 of the first and second insulating cover halves 9,9.

In assembling, the first and second insulating cover halves 9,9 are positioned as opposed to each other on the right and left of the laminated cores 8 incorporated through the plate-like part 6 into the coil bobbin 1 and are moved to the core 8 sides as indicated by the arrows so that the leg parts 8*b* and connecting parts 8*c* outside the cores 8 may enter the core containing parts 10, the first and second insulating cover halves 9,9 are applied onto the cores 8, the engaging projections 12 of the respective tip parts are engaged in the engaging holes 14 to integrally connect both insulating cover halves. By the way, in FIGS. 2 and 4, the reference symbol a designates a positioning projection in the case that the first and second insulating cover halves 9,9 are butted as opposed to each other and are applied to the cores 8.

This projection a is formed on the inside of the engaging projection 12, that is, on the root side of the arm part 9A.

In case the first and second insulating cover halves 9,9 are applied onto the cores 8, the lower connecting piece 13B of the arm part 9B will be positioned below the core 8, will be sloped upward as shown in FIG. 3, will be given a resiliency and will act to push up the core 8, therefore the laminated incorporated core 8 will be pressed upward, that is, in the laminating direction and a gap will be prevented from being generated between the core laminations. Therefore, the electric characteristics of the transformer will not be impaired. In other words, the resilient upper and lower parts 13A and 13B are disposed in converging relation to one another and thus the core laminations received therebetween are automatically compressed to enhance the electrical characteristics of the transformer when the transformer is assembled, there being no need to employ screws or other such devices to accomplish such compression.

Figure 4:
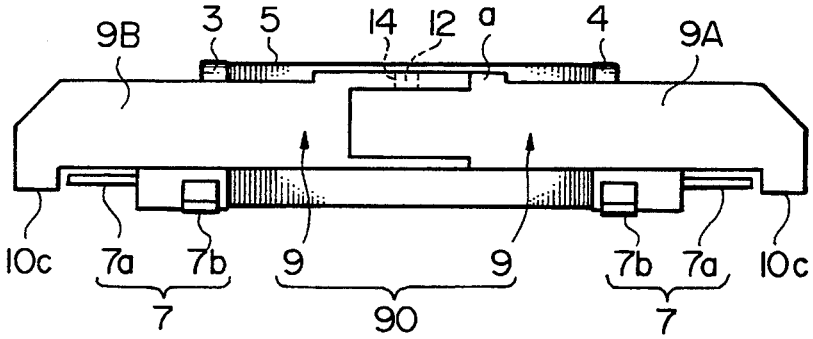
FIG. 4 is a side view showing an embodiment of the present invention.

FIG. 4 shows the transformer as assembled. Projections 10*c* are positioned on the tip surfaces of the end parts 7*a* of the terminals 7 extending in the axial direction and the exposed outer peripheries of the cores 8 are substantially covered with the insulating cover 90 comprising the first and second insulating cover halves 9,9. Also, as the projections 10*c* are located on the end part 7*a* sides of the terminals 7, the end parts 7*a* will be able to be prevented from being impaired.

According to the above mentioned invention, the lower parts of the laminated cores 8 are pushed upward by the connecting pieces 13B having a resiliency while the exposed parts of the laminated cores 8 are being covered with the insulating cover 90 and therefore a gap can be easily prevented from being generated between the respective core laminations.

By the way, this transformer can be used not only for communication devices but also for small pulse transformers and transformers for converters.

The core 8 is shown to be E-shaped in the illustrated embodiment but is not always limited to be E-shaped and may be substantially U-shaped having no central part P or of any other shape.

What is claimed is:

1. A miniature transformer, comprising:

a coil bobbin having a barrel part;

a coil wound about said barrel part;

a first laminated core having a central part received within said coil bobbin and a pair of end parts, coplanar with said central part, disposed externally of said coil bobbin;

a second laminated core having a central part received within said coil bobbin and a pair of end parts, coplanar with said central part, disposed externally of said coil bobbin;

said first and second laminated cores being disposed in opposing relation to one another and said first and second laminated cores abutting one another along a parting line;

an insulating cover means for housing said first and second laminated cores, said insulated cover means including a first U-shaped cover having transversely spaced apart, parallel legs and a second U-shaped cover having transversely spaced apart, parallel legs, said first and second covers being disposed in opposing relation to one another;

compression means for compressing individual plates of said first and second laminated cores toward one another to enhance the electrical properties of the transformer;

said compression means including a first leg of said parallel legs of said first cover having an upper part and a lower part, said upper and lower parts being formed of a resilient material and being disposed in converging relation to one another;

said compression means further including a second leg of said parallel legs of said second cover having an upper part and a lower part, said upper and lower parts being formed of a resilient material and being disposed in converging relation to one another;

interlocking means for interlocking together said first and second covers;

said converging disposition and said resiliency of said first and second leg upper and lower parts providing said compression means when said first and second covers are interlocked.

2. The miniature transformer of claim 1, wherein said interlocking means further comprises a projection formed on an upper part of a first leg of said first cover, and a projection-receiving opening formed on an upper part of a first leg of said second cover so that said projection is received within said projection-receiving opening when said opposing first legs are interlocked with one another.

3. The miniature transformer of claim 2, wherein said interlocking means further comprises a projection formed on an upper part of a second leg of said first cover, and a projection-receiving opening formed on an upper part of a second leg of said second cover so that said projection is received within said projection-receiving opening when said opposing second legs are interlocked with one another.

4. The miniature transformer of claim 3, further comprising an upwardly projecting stop member formed in said upper part of said first leg of said first cover and an upwardly projecting stop member formed in said upper part of said second leg of said second cover to cause alignment of said projections and projection-receiving openings when said first and second cover are interlocked with one another.

* * * * *